United States Patent [19]

Bleibtreu et al.

[11] 3,934,174

[45] Jan. 20, 1976

[54] SURGE VOLTAGE PROTECTION FOR TRANSFER SWITCHES FOR LOAD-TAP CHANGERS

[75] Inventors: Alexander Bleibtreu; Wolfgang Breuer, both of Regensburg; Hans-Henning Mieske, Tegernheim, all of Germany

[73] Assignee: Maschinenfabrik Reinhausen Gebruder Scheubeck K.G., Regensburg, Germany

[22] Filed: Aug. 15, 1974

[21] Appl. No.: 497,606

[30] Foreign Application Priority Data

Nov. 16, 1973 Germany ..... 2357209

[52] U.S. Cl. ..... 317/11 C; 200/11 TC; 323/43.5 R

[51] Int. Cl.[2] ..... G05F 1/14

[58] Field of Search.... 323/43.5 R; 317/11 R, 11 A, 317/11 C; 200/11 TC

[56] References Cited

UNITED STATES PATENTS

| | | | |
|---|---|---|---|
| 3,174,097 | 3/1965 | Bliebtreu | 323/43.5 R |
| 3,813,503 | 5/1974 | Breuer | 200/11 TC |

*Primary Examiner*—J. D. Miller
*Assistant Examiner*—Harry E. Moose, Jr.
*Attorney, Agent, or Firm*—Erwin Salzer

[57] ABSTRACT

A transfer switch for load-tap changers of the Jansen-type is provided with a non-linear surge voltage protective resistor forming a shunt across two taps of a tapped transformer winding and arranged in such a way that a breakdown of the resistor does not result in a short-circuit across the section of the tapped winding situated between the two taps.

2 Claims, 2 Drawing Figures

SURGE VOLTAGE PROTECTION FOR TRANSFER SWITCHES FOR LOAD-TAP CHANGERS

BACKGROUND OF THE INVENTION

This invention relates to load-tap changers for tapped regulating transformers, and more particularly for load-tap changers of the Jansen type. Such load-tap changers include a selector switch used to select the desired tap on a tapped transformer winding, and a transfer switch used to effect tap changes without interrupting the flow of the load current. Selector switches do not make and break, and transfer switches do make and break, energized circuits.

This invention refers more specifically to polyphase Jansen-type transfer switches as shown, for instance, in U.S. Pat. No. 3,396,254 to A. Bleibtreu, Aug. 6, 1968 for ARRANGEMENT FOR AVOIDING EDDY CURRENT LOSSES IN TRANSFER SWITCH AND SELECTOR SWITCH UNITS WITH INTERPOSED GEAR DRIVE and in U.S. Pat. No. 3,671,687 to A. Bleibtreu, June 20, 1972 for TRANSFER SWITCH FOR TAP-CHANGING REGULATING TRANSFORMER INCLUDING LOST MOTION INTERCONNECTION DRIVING MECHANISM.

The primary object of the present invention is to cope effectively by the provision of non-linear voltage surge protective resistors with voltage surges which may occur in equipment of the kind under consideration. Resistors the resistivity of which decreases inversely to the magnitude of the applied voltage are widely used in the art of surge voltage protection. The present invention relates more specifically to the application of voltage surge protective resistors to transfer switches for tapped transformer windings.

Tapped transformer windings are capable of generating very high voltage surges. The magnitude of such voltage surges depends largely upon the structure of the transformer and upon the nature of winding sections situated between a pair of immediately adjacent taps. Oscillatory build-up phenomena occurring in sections of a transformer winding may tend to damage the winding as well as a transfer switch which is connected to it. Among the most critical voltage surges which may impair a transfer switch are those which occur between a selected current carrying and a pre-selected noncurrent carrying tap of a tapped transformer winding. The aforementioned criticality of such voltage surges results from the fact that they appear on various points of a load-tap changer, at the selector switch, at the bushings of the transfer switch, etc. Increasing the dimensions of a load-tap changer and of its transfer switch so as to be capable of withstanding the voltage surges that may occur therein would result in prohibitive cost, and in prohibitive bulk. For these reasons it is necessary to provide means for limiting the magnitude of voltage surges to which a transfer switch may be subjected, e.g. to 120 kV. This is currently generally achieved by non-linear surge protective resistors which interconnect permanently a selected current carrying tap with a selected noncurrent carrying tap.

In the past the provision of such surge protective resistors resulted in a real danger to the equipment in connection with which they were used. Such resistors undergo changes which may be due to various reasons, including thermal ageing, resulting in instability of the current path formed by the resistors. In the worst possible case the resistance of the voltage surge protective resistor may drop to zero, thus resulting in a short-circuit of the section of the tapped winding situated between two taps which are interconnected by the resistor. Such a short-circuit may cause severe damage, including total destruction of the regulating transformer.

Heretofore non-linear tap-interconnecting voltage surge protective resistors were arranged in the same space as the tapped transformer and the selector switch, which is generally an oil-filled tank. This tends to make matters even worse because it renders the resistors relatively inaccessible for maintenance checks and repairs.

Another means for protecting transfer switches in load-tap changers against surge voltages is the provision of protective spark gaps therein supposed to break down incident to a voltage surge of predetermined magnitude. The provision of spark gaps for the above purpose is, however, subject to very serious limitations and drawbacks. It is difficult to maintain precisely the required spacing between the electrodes of a spark gap, and its breakdown voltage changes also with the dielectric — normally oil — in which the spark gap is submersed. The response characteristics of spark gaps are, therefore, wide bands rather than lines. Once a spark gap breaks down, the electric discharge across the gap may continue indefinitely. The fact that the response characteristics of spark gaps are wide bands may result in a gap breakdown during routine voltage tests, and such a gap breakdown cannot be distinguished from an insulation breakdown somewhere in the load-tap changer.

These were the principal reasons for the trend of using non-linear voltage surge protective resistors rather than arc gaps for the protection of load-tap changers. However, as is apparent from the above, the current use of non-linear resistors as surge voltage protectors in load-tap changers is likewise not a satisfactory or safe measure.

SUMMARY OF THE INVENTION

Transfer switches embodying this invention include a pair of terminals for connecting the contact means of the transfer switches to a pair of taps of a tapped transformer winding. The aforementioned contact means include a pair of relatively movable switch-over contact means and a pair of relatively movable current-carrying contact means. The former are each arranged to connect selectively one of said pair of terminals to an outgoing load-current-carrying line. The transfer switches further include a pair of switch-over resistors each interposed between one of said pair of terminals and one of said pair of switch-over contact means. Each of the aforementioned pair of relatively movable current-carrying contact means is shunted across one of said pair of switch-over contact means to connect selectively each of said pair of terminals directly with said outgoing load-current-carrying line. The aforementioned contact means are arranged inside of a tank containing a body of insulating fluid. A non-linear surge voltage protective resistor is arranged inside said tank, submersed in said body of insulating fluid and interconnecting the ends of said pair of switch-over resistors remote from said pair of terminals and adjacent said pair of switch-over contact means so that in case of breakdown of said surge protective resistor the current resulting from a voltage applied across said pair of terminals is limited by said pair of switch-over resistors.

DESCRIPTION OF PREFERRED EMBODIMENT

Figure 1:
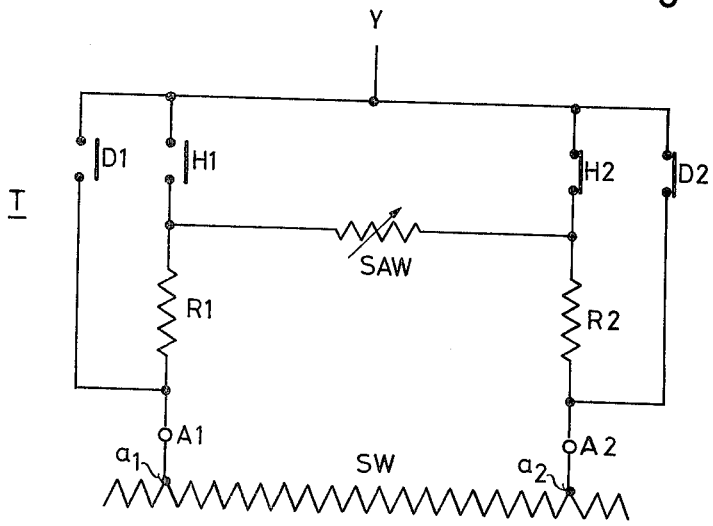
FIG. 1 is a circuit diagram of a single-phase transfer switch embodying this invention.

Referring now to FIG. 1, characters SW have been applied to indicate a tapped transformer winding having two taps $a_1,a_2$. Tap $a_1$ is conductively connected to terminal $A_1$ of a transfer switch generally designated by reference character T, and tap $a_2$ is conductively connected to terminal $A_2$ of said transfer switch T. Reference characters $H_1,H_2$ have been applied to indicate a pair of relatively movable switch-over contact means arranged to connect selectively each of terminals $A_1,A_2$ to an outgoing load-current-carrying line Y. Each of a pair of switch-over resistors $R_1,R_2$ is interposed between one of terminals $A_1,A_2$ and one of the pair of switch-over contact means $H_1,H_2$. Each of switch-over contact means $H_1,H_2$ includes a pair of fixed contacts and a contact bridge movable relative to said pair of fixed contacts. As shown in FIG. 1 switch-over contacts $H_1$ are open and switch-over contacts $H_2$ are closed. Reference characters $D_1,D_2$ have been applied to indicate a pair of current-carrying contact means each shunted across one of said pair of switch-over contact means $H_1,H_2$ to connect selectively each of said pair of terminals $A_1,A_2$ directly with said outgoing load-current-carrying line Y. As shown in FIG. 1 contact means $D_2$ is closed and contact means $D_1$ is open.

The structure described so far is that of a conventional Jansen type transfer switch. In FIG. 1 the selector switch normally interposed between winding SW and transfer switch T has been deleted, the arrangement of a selector switch having been shown in the prior art patents referred-to above, and its presence or absence being of no import as far as an understanding of this invention is concerned.

In FIG. 1 reference sign SAW has been applied to indicate a non-linear surge voltage protective resistor interconnecting the ends of switch-over resistors $R_1,R_2$ remote from terminals $A_1,A_2$. In other words, resistor SAW interconnects the ends of switch-over resistors $R_1,R_2$ adjacent switch-over contact means $H_1,H_2$.

In the position of parts shown in FIG. 1 a current flows from tap $a_2$ by way of terminal $A_2$ and current-carrying contact means $D_2$ to line Y. Preparatory to a change-over from tap $a_2$ to tap $a_1$ the current-carrying contact means $D_2$ is opened. This establishes a current path from tap $a_2$ by way of terminal $A_2$, switch-over resistor $R_2$ and switch-over contact means $H_2$ to line Y. Thereupon switch-over contact means $H_1$ is closed, establishing a current path from tap $a_1$ by way of terminal $A_1$, switch-over resistor $R_1$ and switch-over contact means $H_1$ to line Y. The next step in the tap-changing process consists in opening or separating switch-over contacts $H_2$, as a result of which line Y henceforth is supplied with current from tap $a_1$ only. The tap-changing operation is completed by closing current-carrying contacts $D_1$, thus shunting the current from tap $a_1$ and terminal $A_1$ around switch-over resistor $R_1$ and switch-over contact means $H_1$.

The presence of non-linear surge voltage protective resistor SRW normally prevents dangerous voltage surges on account of the equalization current path which it provides. If the resistance of resistor SRW should drop close to zero on account of ageing, or for some other reason, the location of resistor SRW, or its topology, preclude such defect to turn into a short-circuit across the section of transformer winding SW situated between taps $a_1,a_2$. In case of breakdown of resistor SRW the current resulting from a voltage applied across terminals $D_1,D_2$ is limited by switch-over resistors $R_1,R_2$ connected in series with resistor SRW.

Switch means $D_1,D_2,H_1,H_2$ and resistors $R_1,R_2$ and SAW are preferable housed in a common tank separate from the tank housing the transformer, its tapped winding SW and the selector switch (not shown). This separate tank is filled with oil, or another insulating fluid, as will be shown below in more detail in connection with FIG. 2. The arrangement of resistor SAW in the tank housing the transfer switch rather than in the tank housing the transformer proper makes it relatively easy to perform maintenance checks of resistor SAW and to replace the latter if found to be defective. The tanks of transfer switches are generally provided with relays responsive to the generation of gas inside of said tanks. Since deterioration and breakdown of resistors SAW are likely to result in gas evolution, these relays will generally respond to a defect of resistors SAW and thus operate as fault locators at no extra cost.

Figure 2:
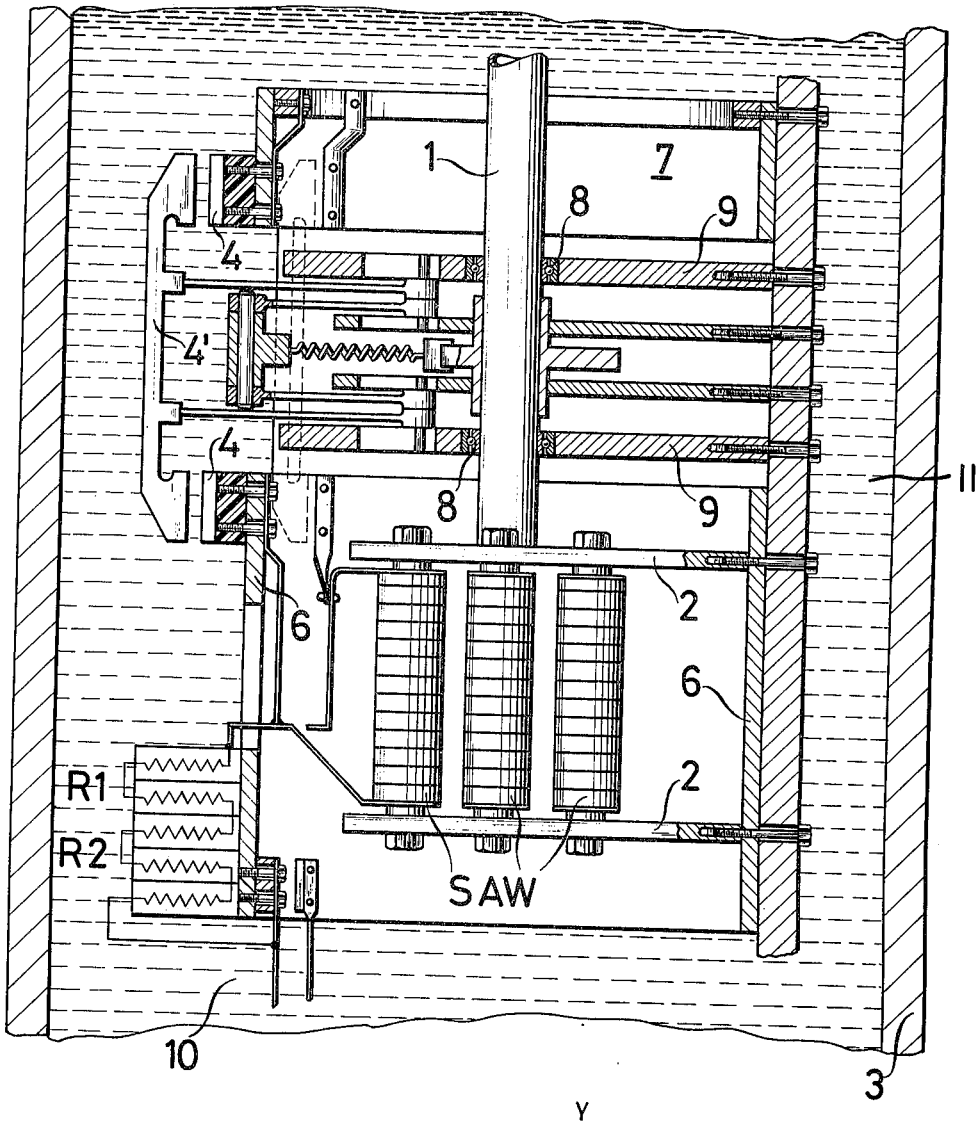
FIG. 2 is in part a vertical section and in part a front elevation of a polyphase or three phase transfer switch embodying this invention.

Referring now to FIG. 2, numeral 1 has been applied to indicate the operating shaft for a polyphase transfer switch arranged inside of a tank 3. Tank 3 is cylindrical and shaft 3 is arranged inside of tank 3 in coaxial relation to the latter. Reference numeral 4 has been applied to indicate fixed contacts and reference numeral 4′ has been applied to indicate a movable contact bridge. The contacts 4,4′ of FIG. 2 are the equivalents of contacts $H_1,H_2,D_1,D_2$ of FIG. 1, i.e. contacts 4,4′ may be considered either as switch-over contacts, or as current-carrying contacts. In the position shown in FIG. 2 contact bridge 4′ is separated from fixed contacts 4. Contact bridge 4′ may be caused by a rotary motion of shaft 1 to move radially inwardly into engagement with fixed contacts 4. Reference character 7 has been applied to generally indicate a mechanism for converting the rotary motion of shaft 1 into radially inward and radially outward motions of contact bridges 4′. Such a mechanism has been shown in detail in the above referred-to U.S. Pat. No. 3,674,687. This patent also shows that the fixed contact means and the movable contact means of each of the three phases are grouped in the form of a cylinder sector or a cylinder segment. In a three phase transfer switch the number of such sectors or segments is three. These sectors or segments are angularly displaced 120°. Reference numeral 8 has been applied to indicate a pair of bearings for shaft 1 supported by horizontal partitions 9. The cylinder 6 of electric insulating material is arranged inside of tank 3 in coaxial relation to the latter, and at a level below that of contact bridge operating mechanism 7 and contact means 4,4′,4. The switch-over resistors $R_1,R_2$ of each phase of the transfer switch are arranged inside of an annular space 10 bounded radially outwardly by tank 3 and radially inwardly by insulating cylinder 6. While FIG. 2 shows but two switch-over resistors $R_1,R_2$, it will be understood that since the structure of FIG. 2 is a three phase structure it includes $3 \times 2 = 6$ switch-over resistors $R_1,R_2$ all of which are arranged inside of space 10. Reference characters SAW have been applied to indicate three non-linear surge voltage protective resistors each for one of the three phases of the transfer switch shown in FIG. 2. These resistors SAW are in the form of columns parallel to and spaced from the axis of cylinder 6 and arranged inside of the latter. Resistors SAW are arranged inside of cylinder 6 between a pair of parallel support plates 2. It will be apparent from FIG. 2 that all resistors $R_1$,$R_2$ and SAW are arranged at a level below contact means 4,4', and below their drive mechanism 1,7. Cylinder 6 forms a partition separating resistors $R_1$,$R_2$ from resistors SAW. Reference numeral 11 has been applied to indicate a body of insulating fluid, e.g. oil, inside of tank 3 in which parts 1,4,4',6,7 and $R_1$,$R_2$ and SAW are submersed. The arrangements of parts shown in FIG. 2 maximizes compactness and insulation levels and facilitates wiring of the constituent parts of the transfer switch.

We claim as our invention:

1. In a transfer switch for load-tap changers the combination of a. a pair of terminals for connecting the contact means of the transfer switch to a pair of taps of a tapped transformer winding;

b. a pair of relatively movable switch-over contact means each arranged to connect selectively each of said pair of terminals to an outgoing load-current-carrying line;

c. a pair of switch-over resistors each interposed between one of said pair of terminals and one of said pair of switch-over contact means;

d. a pair of relatively movable current-carrying contact means each shunted across one of said pair of switch-over contact means to connect selectively each of said pair of terminals directly with said outgoing load-current-carrying line;

e. a tank with a body of insulating fluid therein housing said pair of switch-over contact means and said pair of current-carrying contact means; and f. a non-linear surge voltage protective resistor arranged inside said tank submersed in said body of insulating fluid and interconnecting the ends of said pair of switch-over resistors remote from said pair of terminals and adjacent said pair of switch-over contact means so that in case of breakdown of said surge protective resistor the current resulting from a voltage applied across said pair of terminals is limited by said pair of switch-over resistors.

2. A polyphase transfer switch as specified in claim 1 wherein a. said pair of relatively movable switch-over contact means and said pair of current-carrying contact means are arranged inside of a cylindrical tank and operable by a driving shaft arranged in coaxial relation to said tank;

b. a cylinder of electric insulating material is arranged inside of and in coaxial relation to said tank;

c. said pair of switch-over resistors for each of the phases of said transfer switch are arranged inside the annular space bounded by said tank and said cylinder of insulating material; and wherein d. said non-linear voltage surge protective resistor for each of the phases of said transfer switch is in the form of a column arranged inside said cylinder of insulating material and parallel to and spaced from the axis thereof.

* * * * *